US008434834B2

(12) United States Patent
Freimuth

(10) Patent No.: US 8,434,834 B2
(45) Date of Patent: May 7, 2013

(54) TOOL STORAGE CABINET AND ATTACHED VISUAL TOOL IDENTIFICATION AND LOCATION SYSTEM

(75) Inventor: Edward K. Freimuth, Palos Heights, IL (US)

(73) Assignee: Versatility Tool Works & Manufacturing Company, Inc, Alsip, IL (US)

( * ) Notice: Subject to any disclaimer, the term of this patent is extended or adjusted under 35 U.S.C. 154(b) by 300 days.

(21) Appl. No.: 12/623,699

(22) Filed: Nov. 23, 2009

(65) Prior Publication Data

US 2011/0121699 A1 May 26, 2011

(51) Int. Cl.
*A47B 81/00* (2006.01)
*B42F 21/00* (2006.01)

(52) U.S. Cl.
USPC ..... 312/234.2; 312/902

(58) Field of Classification Search ..... 312/234.3, 312/234.2, 234, 234.4, 234.5, 234.1, 351, 312/280, 902, 311, 348.3, 245, 301, 209; 206/372, 373
See application file for complete search history.

(56) References Cited

U.S. PATENT DOCUMENTS

| | | | | | |
|---|---|---|---|---|---|
| 353,770 | A | * | 12/1886 | Wormser | 312/119 |
| 363,083 | A | * | 5/1887 | Rieder | 312/234.3 |
| 796,600 | A | * | 8/1905 | McLane et al. | 312/234.2 |
| 947,967 | A | * | 2/1910 | Gardner | 312/270.3 |
| 1,662,885 | A | * | 3/1928 | Dell | 312/300 |
| 1,948,738 | A | * | 2/1934 | Thayer | 312/234 |
| 1,974,234 | A | * | 9/1934 | Byrnes et al. | 217/7 |
| 2,286,427 | A | * | 6/1942 | Levensten | 312/222 |
| 2,530,220 | A | * | 11/1950 | Belcher | 312/301 |
| 3,238,629 | A | * | 3/1966 | Hurwitz | 33/548 |
| 3,760,489 | A | | 9/1973 | Griffith | |
| 3,804,238 | A | * | 4/1974 | Howard | 206/459.5 |
| 4,742,470 | A | | 5/1988 | Juengel | |
| 5,725,096 | A | * | 3/1998 | Winnard | 206/350 |
| 5,797,491 | A | | 8/1998 | Fierek et al. | |
| 6,082,227 | A | | 7/2000 | Vogel | |
| 6,422,671 | B1 | * | 7/2002 | Lodge et al. | 312/245 |
| 6,668,751 | B1 | | 12/2003 | Henke | |
| 6,915,952 | B1 | | 7/2005 | Allen | |
| 7,132,926 | B2 | | 11/2006 | Vaseloff et al. | |
| 7,338,139 | B2 | | 3/2008 | Peter | |
| 2002/0145025 | A1 | | 10/2002 | Gilbert | |
| 2003/0227148 | A1 | | 12/2003 | Shipman et al. | |
| 2004/0007548 | A1 | | 1/2004 | Tilly | |
| 2004/0115021 | A1 | | 6/2004 | Carmichael | |
| 2004/0232809 | A1 | * | 11/2004 | Buchman-Ziv | 312/234.1 |
| 2004/0256335 | A1 | * | 12/2004 | Sholem | 211/70.6 |
| 2005/0236940 | A1 | * | 10/2005 | Rockoff | 312/209 |
| 2008/0012455 | A1 | | 1/2008 | Zheng | |

* cited by examiner

*Primary Examiner* — Darnell Jayne
*Assistant Examiner* — Andres F Gallego
(74) *Attorney, Agent, or Firm* — Joseph Golant

(57) ABSTRACT

A tool identification and location system for a tool containing cabinet. The system includes a plastic sheet having a surface with cross sectional outlines of the cabinet drawers as well as multiple, parallel tool receiving compartments in each of the drawers. The sheet is connected to a sidewall of the cabinet so that the outlines of each drawer are in horizontal alignment with corresponding drawers of the cabinet, and tool cross sections, called profiles, are mounted to the sheet, such as by magnets or hook and loop fasteners, for indicating to an operator the exact location, drawer and compartment, of each tool in the cabinet.

18 Claims, 5 Drawing Sheets

TOOL STORAGE CABINET AND ATTACHED VISUAL TOOL IDENTIFICATION AND LOCATION SYSTEM

FIELD OF THE INVENTION

The present invention relates to a unique visual information system including a movable cabinet for storing and protecting tools for industrial use. More particularly, the invention relates to storage and ready use of tools and a visual system for rapidly identifying the tools held in a storage cabinet for ready use of the stored tools to reduce machine setup time as needed to reduce the cost of identifying and changing tools as required.

BACKGROUND OF THE INVENTION

Examples of earlier tool identification systems have been found in the following earlier patents. U.S. Pat. No. 3,760,489 to Griffith, "Tool Storage and Identification System" relates to tool storage and identifying means including an improved storage magazine to rotate about a horizontal support axis and provided with improved socket adapters to receive a combination of rearward coded tools.

U.S. Pat. No. 4,742,470 to Juengel, "Tool Identification System" identifies tools used in an automatic machine tool system. A transponder is mounted to each tool and interrogated by a transceiver to identify the tool.

U.S. Pat. No. 4,982,627 to Johnson, "Color Coded Tools" uses a color-coded tool identification method to indicate size of hand tools and small cutting tools.

U.S. Pat. No. 5,797,491 to Fierek, "Tool Carrier Organizer" relates to a soft fabric carrier organized in the form of a receptacle comprising several partitions formed on the outside surface of the organizer.

U.S. Pat. No. 6,082,227 to Vogel, "Visual Coding System for Tool Size" codes tools as to their size, using two sets of different colored bands on the surface of the tool.

U.S. Pat. No. 6,668,751 to Henke, "System and Method for Identifying Hand Tools" provides a color-coded identification system for identifying a hand tool. A chart defines operating characteristics of the hand tool by a group of colors.

U.S. Pat. No. 7,132,926 to Vaseloff, "Smart Tray Syste3m and Method for Restaurant Inventory Management" includes a plurality of information tags and communication devices that communicate with the tags.

U.S. Pat. No. 7,338,139 to Peter, "Cabinet Apparatus for Kitchen Utensils and Appliances" includes a cabinet apparatus for efficient organization storage and use of kitchen appliances and utensils in a relatively small space.

SUMMARY OF THE INVENTION

Press brake tools are a good example of the tools that may be stored in industrial tool storage cabinets used in the system of the present invention. Press brake tools are used for bending sheet metal in sheet metal presses. Sheet metal presses are commonly equipped with a lower table and an upper table, one of which is vertically movable toward the other table. Forming tools are mounted on the tables so that when the tables are brought together, the sheet metal work piece between the forming tables is bent into a desired shape. It is common for the upper table to use a male forming die which has a deforming surface of a desired shape such as a right angle and for the lower table to have an appropriately shaped and aligned die so that when the two dies are brought together a sheet metal work piece between the forming dies or tools is formed into a desired bent shape. The forming tools commonly are horizontally elongated so that work pieces of various widths can be accommodated.

It is often necessary to identify and exchange forming tools when a different bending operation is to be performed. The dies, commonly resting on the bottom table of a press brake are readily removed and exchanged for others. The forming tools usually mounted to the upper table also are usually easily replaced. It is essential that the male forming die of the upper table appropriately match the appropriately shaped die of the bottom table to obtain an appropriate bent shape of the sheet metal workpiece. Visual inspection of the two dies during the process of exchange aids in the appropriate matching of the two dies.

In more detail, the instant invention includes a movable cabinet for containing press brake tools to be identified and located allowing quick exchange of tools at a workstation or other device.

The movable cabinet includes four support swivel wheels and several drawers for containing press brake tools within each drawer, for example. The press brake tools are supported within each drawer by support structures. The number of press brake tools in each drawer is a function of the space available and the number of tools to be stored. On the outer metal side of the movable cabinet, a sheet of approximately equal size to the side of the cabinet is attached to the side of the cabinet. The attached sheet provides a visual structure representing the drawers and the support structure in the drawers of the cabinet.

The sheet provides for the full scale visual aid of each drawer's contents. The cabinet has several drawers which extend across the width of the cabinet, each drawer for containing press brake metal forming tools.

As noted above, the sheet, which may be made of metal, plastic, or other material that is flat and firm and can be written upon, is attached to the outer side of the cabinet. The sheet has depictions of the drawers and the drawer depictions line up with the drawers in the cabinet. The sheet also has a depiction of each storage compartment of each drawer. The sheet contains thereon a pictorial representation of the press brake tool contained within each storage compartment of each of the drawers.

Each sheet as noted may be formed of plastic, a cardboard, or metal of close to equal size to the dimensions of the side of the cabinet. The sheet carries on its surface at least one pictorial representation of the contents of each drawer. The sheet replicates visually the contents of the several drawers contained in the cabinet across the width of the cabinet.

Several methods of providing a sheet of material upon which is mounted visual representations of the contents of the individual drawers containing tools. The visual tool identification structures of the contents of the multiple drawers of the cabinet is attached to the sheet. The sheet can be attached to an underlying sheet support layer, or a plurality of sheet support layers, or may be directly attached to the side of the cabinet. Differing weights of the sheet material can be used. The depiction of the individual tools contained in the movable storage drawers can be in full color and of actual size, or the depiction of each tool it can be a cross-section of the tool representing the tool's dimensions or a percentage thereof.

Aspects of the instant invention are taught in the prior art, i.e. a tool storage and identification system, a module or transponder mounted to the tool and interrogated by a transceiver to identify tools, a color coded system is used to identify the tools instantly, a system of marking tools and coding tools by color dots to indicate tool size and using tags to identify process steps and inventory in process. The present invention is more cost effective, and more efficient. The identification of the exact tool and the tool's dimensions and its exact location saves time to find and identify the tool. Time is also saved in the management and set-up of any operation. The use of visual representations of tools specifically noting their locations within a specific drawer of a cabinet has not been previously disclosed in the prior art. Further, the unique means of presenting the visual material has not been previously disclosed in the prior art.

DESCRIPTION OF THE PREFERRED EMBODIMENTS

Figure 1:
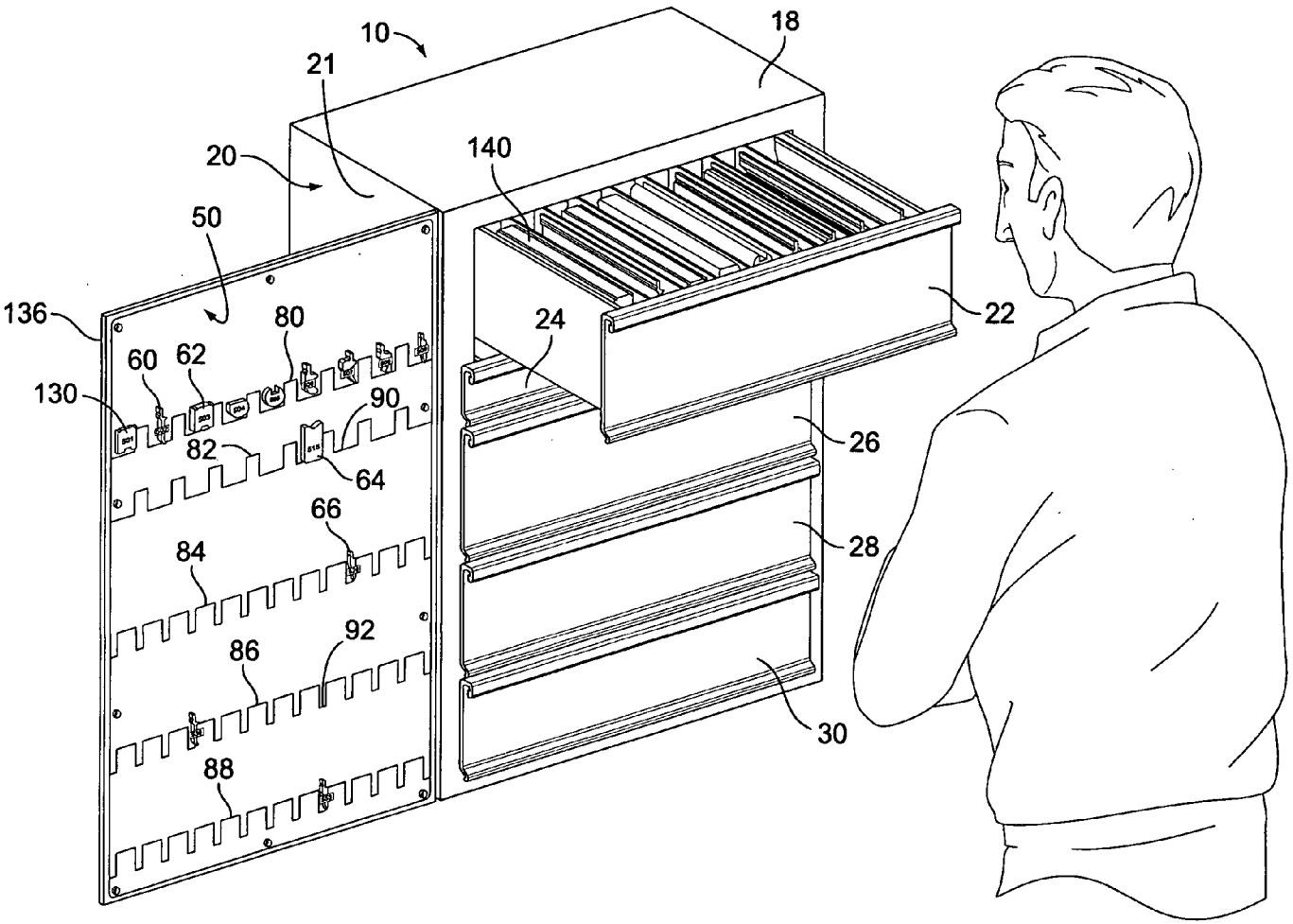
FIG. 1 is a perspective view of a tool storage cabinet and an attached visual depiction sheet with identifying tool profiles of tools within the storage cabinet, the visual depiction sheet containing cross sectional outlines of cabinet drawers and of tool receiving compartments within each of the drawers, the outlines being aligned with the drawers of the cabinet.
Figure 2:
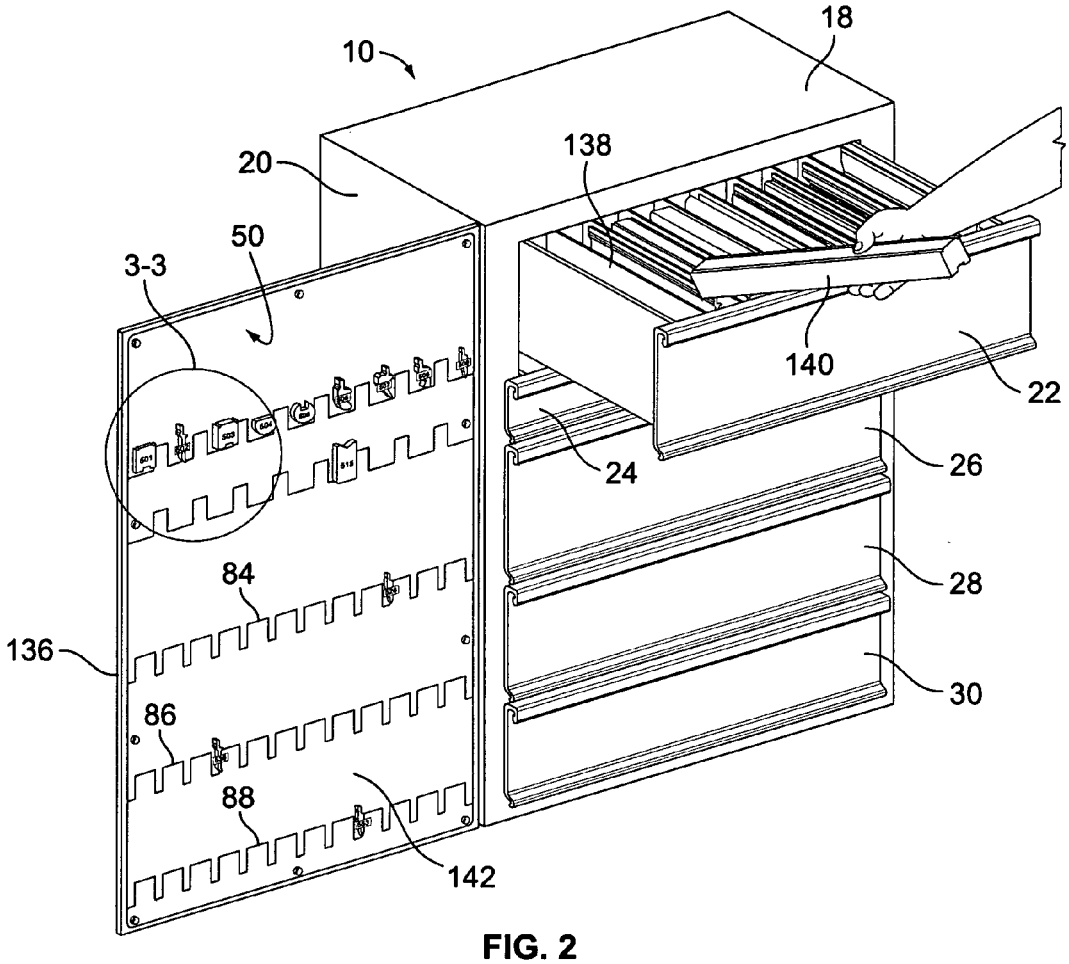
FIG. 2 is a perspective view of the tool storage cabinet and the sheet shown in FIG. 1, illustrating the top drawer of the tool cabinet in an open position and a press brake tool being removed from a storage compartment by an operator.
Figure 6:
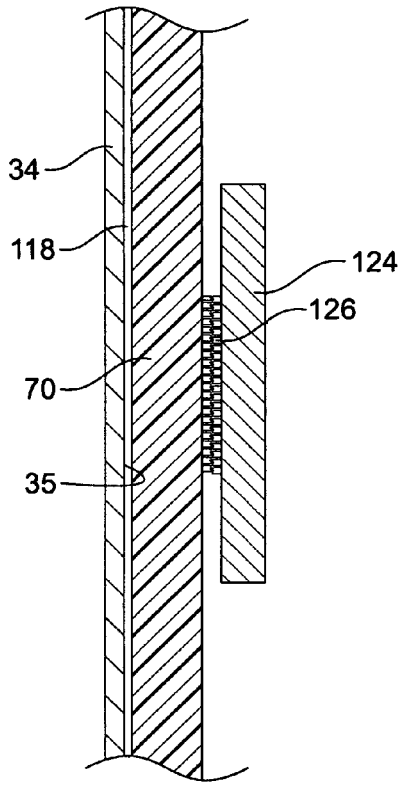
FIG. 6 is an enlarged cross section view taken along line 6-6 of FIG. 8, showing a tool profile attached to the sheet by a hook and loop fastener.
Figure 7:
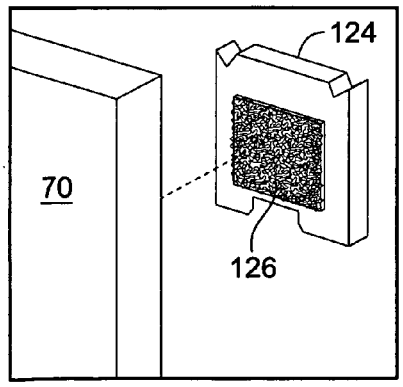
FIG. 7 is an exploded view showing the tool profile and the hook and loop fastener shown in FIG. 6.
Figure 8:
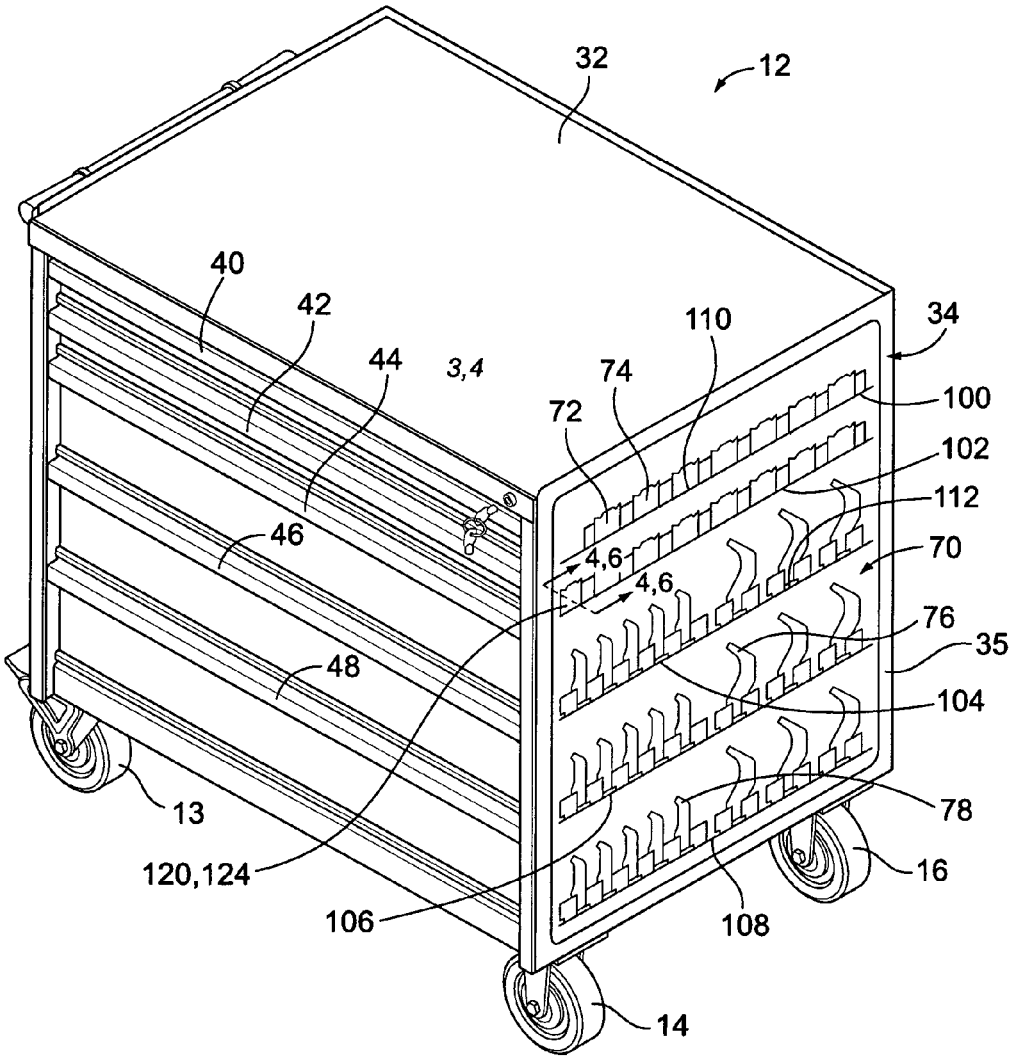
FIG. 8 is a perspective view of another embodiment of a movable tool storage cabinet, a sheet attached to the side of the cabinet, the sheet having cross sectional outlines representing drawers and tool receiving compartments in the drawers, the outlines of the drawers being aligned with the drawers of the cabinet, and a plurality of tool profiles attached to the sheet, the tool profiles for representing tools stored in the drawers and compartments in the locations indicated.
Figure 9:
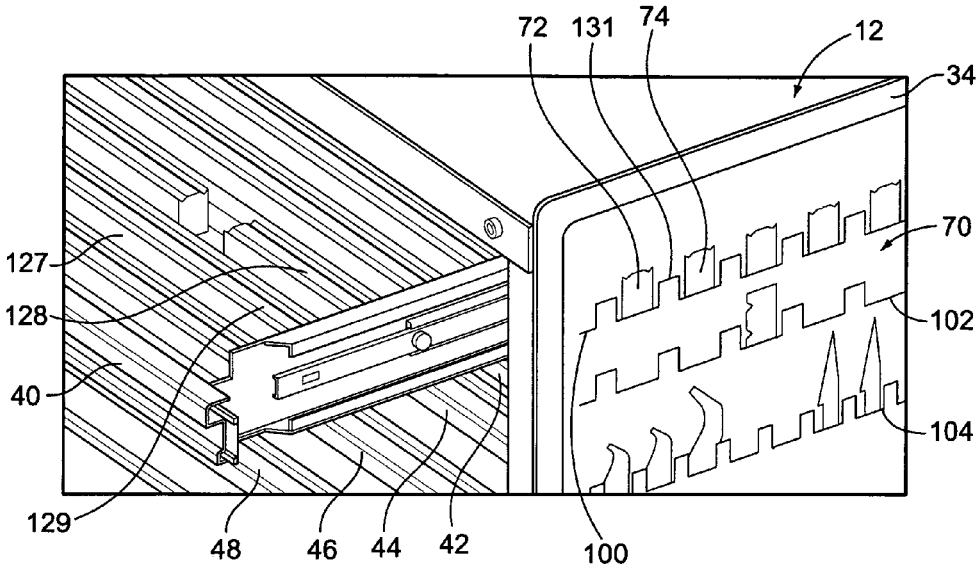
FIG. 9 is a perspective view of the cabinet shown in FIG. 8, with a partially open drawer illustrating tools in the drawer compartments matching the locations of the tool profiles attached to the sheet.

Referring now to FIGS. 1-9, there is illustrated tool storage cabinet 10 in FIGS. 1 and 2, with movable support wheels (not shown) and a movable tool storage cabinet 12 in FIGS. 8 and 9. The cabinet 10 has a top 18, two sidewalls of which only the sidewall 20 is shown, and five drawers 22, 24, 26, 28, 30. The sidewall 20 includes an outer surface 21. The cabinet 12 also includes a top 32, two sidewalls of which only the sidewall 34 is shown, and five drawers 40, 42, 44, 46, 48. The sidewall 34 includes an outer surface 35.

A sheet 50 is attached to the outer surface 21 of the sidewall 20 of the movable storage cabinet 10, the sheet having visual depictions of the tools, such as tool profiles 60, 62, 64, 66, on the sheet 50 brought into horizontal alignment with the cabinet drawers. A sheet 70 is attached to the outer surface 35 of the sidewall 34 of the cabinet 12 with the visual depictions of tools connected, such as the tool profiles 72, 74, 76, 78. As seen in FIGS. 1 and 2, the drawers 22, 24, 26, 28, 30 are in alignment with depictions of the drawers in the form of drawer cross sectional outlines 80, 82, 84, 86, 88 and tool receiving compartments outlines, such as the compartment outline 90, part of the drawer outline 82, and the compartment outline 92, part of the drawer outline 86 illustrated on the sheet.

As seen in FIGS. 8 and 9, the drawers 40, 42, 44, 46, 48 are in alignment with cross sectional outlines 100, 102, 104, 106, 108 of the drawers and outlines of the compartments, such as the compartment outline 110 as part of the drawer outline 100 and compartment outline 112 as part of the drawer outline 104, formed on the sheet 70. The contents of a specific drawer, and the specific location of specific tools in each drawer are represented in FIGS. 1 and 2, by the tool profiles shown in enlarged detail in FIG. 3. An enlarged view of the pictorial representation of a tool stored in each of the drawers of the cabinet 12, and as attached to the sheet 70, is shown in FIG. 4.

Figure 4:
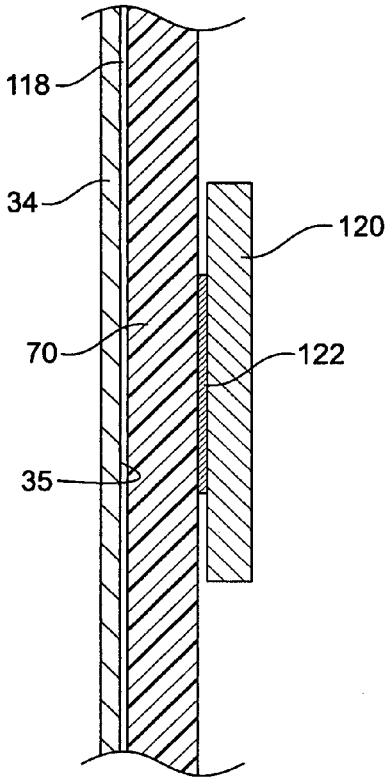
FIG. 4 is an enlarged cross section view taken along line 4-4 of FIG. 8, showing a tool profile attached to a sheet by a magnet.
Figure 5:
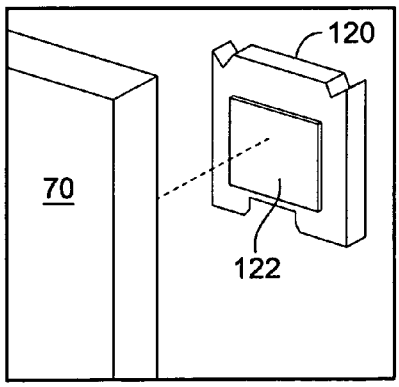
FIG. 5 is an exploded view illustrating the tool profile and the magnet shown in FIG. 4.

FIG. 4 is a side sectional view of a visual tool identification profile 120 attached to the sheet 70, and the sheet 70 is attached to the outside surface 35 of the sidewall 34 of the cabinet 12 by an adhesive 118. The visual tool identification profile 120 is attached to the sheet 70 by an attachment structure, in this case a magnet 122. FIG. 5 shows the magnet 122 attached to the profile 120 and then attached to the sheet 70 that is attached to the cabinet. FIG. 6 is also a side sectional view of a visual tool identification profile 124 with an alternative attachment structure, such as a hook and loop fastener 126, frequently marketed under the trademark, VELCRO, one part of the fastener being attached to the sheet 70 and other part being attached to the tool profile 124. The sheet 70 is attached to the outer surface 35 of the sidewall 34 of the cabinet 12 by an adhesive 118. FIG. 7 shows the visual tool identification profile 124 with the alternative hook and loop fastener 126, attached to the sheet 70.

Figure 3:
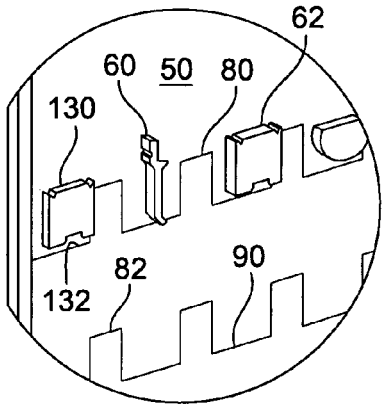
FIG. 3 is an enlarged view taken within circle 3-3 of FIG. 2, illustrating tool profiles located on the sheet on outlines of specific storage compartments of specific drawers within the cabinet.

FIGS. 1, 2, and 3, further illustrate the location of the tools represented on the sheet 50 in specified storage compartments of specific cabinet drawers in the cabinet 10, such as by the profile 130 on the outline 80 in the compartment outline 132. The contents of a specific drawer, and the specific location of specific tools in each drawer are represented by the tool profiles. For example, the tool profile 72, FIGS. 8 and 9, represents the tool 127 and its location in the drawer 40. The tool profile 74 represents the tool 128 and its location in the drawer 40. The outline portion 131 on the sheet 70 represents a divider 129 between the tools 127 and 128.

The sheet 50 can be attached to an underlying sheet support layer 136, as shown in FIGS. 1 and 2, or directly attached to the side of the movable storage cabinet 12, as shown for the sheet 70 in FIGS. 8 and 9. A bolt, a screw, a hinge, adhesive, a hook and loop mechanism, a magnet, or other means of attachment can be used to attach the sheet 70 to the side of the cabinet 12 or the sheet 50 to the support layer 136, and the support layer 136 to the sidewall of the cabinet 10. The visual tool identification profiles are attached to the sheet 50, or the sheet 70 bearing the outlines of the drawers and compartments of the respective cabinets 10, 12. The tool profiles are attached to the sheet by an attachment structure. For example, an attachment structure, which is preferably like the magnet 122, attached to the back of the tool profile 130, attaches the visual identification tool profile 130 to the correct location on the sheet 50, and the sheet 50 is horizontally aligned with the location of the compartment 138 in which a corresponding tool 140 is stored. The tool profile 130 with an attachment structure is attached to the sheet 50 in a specific location on the sheet outline 80 of the configuration of a compartment 132 indicating the specific storage compartment 138 of a specific cabinet drawer 22 containing the tool 140, and providing a full pictorial representation of the tool and its location on the side of the cabinet.

In detail, the instant invention relates to a movable storage cabinet 10, 12 for tools of several sizes and uses. A visual representation of the tool, the tool profile, within each storage compartment of each drawer is presented upon the surface 142 of the sheet 50 attached or connected to the sidewall of the storage cabinet. Each visual representation of the tools stored within the drawer compartments is a tool profile that provides a cross sectional view of the corresponding tool in the cabinet.

Tool cabinets are preferred over open shelving for storing and retaining tools because the cabinets more adequately protect the tools from dust and keep the tools clean. In addition, the cabinets also hide the tools from plain view, and help prevent theft of the tools by keeping the tools hidden and locked in the cabinet or drawer if desired. The tools are then not only hidden from plain view but are stored away and locked if desired.

It is difficult for a press brake operator, for example, or other craftsman to remember where a tool is located in a tool storage cabinet when the operator needs it. Opening the storage drawer and simply looking for the proper tool takes time. The instant invention provides a visual depiction in the form of outlines on the sheet which allows the operator or craftsman to locate the required tool quickly. This visual depiction reduces machine setup time and saves money.

The visual depiction sheet is applied to the exterior side of the tool cabinet as shown in FIGS. 8 and 9 or connected to the sidewall as shown in FIGS. 1 and 2. The individual tool profiles are located on the outer surface of the sheet attached or connected to the side of the tool cabinet. The sheet is affixed to the outer side of the cabinet by an attachment structure. The attachment or connection structure for the sheet may be a suitable adhesive, bolts, screws, or other mechanism. The visual tool identification profiles are attached to the sheet by hook and loop fasteners, mechanical devices, or in the case of a magnetic surface by magnets, which then provides the visual depiction of the tool's identity and location.

The sheet 50, 70 is of suitable size and is attached or connected to an exterior side of the cabinet.

The visual depiction sheet can be placed anywhere on the cabinet, including the front of the cabinet if panels are used. The visual depiction sheet is aligned horizontally with each drawer the sheet depicts. The visual depiction sheet then provides a representation for each drawer in the cabinet. The scale of the tool profile can be larger or smaller than a full size replica of the tool within the cabinet drawer.

The tool profiles placed on the sheet are in of the same order as the tools placed in each storage compartment in each drawer. If a tool is moved to another drawer, the tool profile may be moved to a new location on the sheet representing the change in the tool's location in the cabinet.

The sheet 50, 70 includes is a flat surface to which the tool profiles are attached. The sheet and the tool profiles represent the contents of the cabinet. The tool profiles are cross sectional views of the actual tools. The tool profiles can be full size representations, that is, full size representations of tool cross sections or a percentage of the dimensions of the tool. These profiles are instantly recognizable by someone skilled in the art, in this example, sheet bending operators. The tool profiles also may be labeled with a tool manufacturer's tool number and size. If the tool profiles are magnetic, the tool profiles will adhere to a steel metal sheet. If hook and loop fasteners are used, the fastener part on the back of a tool profile is aligned with the corresponding compartment represented on the sheet, and the sheet will have fastener patches in each compartment, so that the sheet will depict the exact location of the tool in the cabinet.

Previously, it was common to place individual labels on the front of the tool cabinet drawers to identify the drawer contents. Due to size restrictions, there often was a lack of detailed data on the labels. Also, the labels were often difficult to change if the labels were mounted on the cabinet.

In contrast, the instant invention provides cross sectional profiles of the tools in the cabinet. As noted, these profiles are instantly recognizable by someone skilled in the art. Tool cabinets are used for storing tools because they protect the tools and keep them clean. The tool cabinet also hides the tools from plain view. It is difficult for an operator to remember where a tool is located in a tool cabinet when the operator needs it. The instant invention provides a visual depiction of the tool, which helps the operator located the tool quickly.

The instant invention accordingly includes a cabinet in size, sufficient to contain at least several drawers containing compartments of sizes sufficient to contain removable tools, wherein each cabinet drawer is represented on a sheet displaying the size of each cabinet drawer, and its compartments, where identification profiles detailing the tool contents of the drawers are depicted, and where the identification profiles affixed to the sheet depict the identifications and locations of the tools within the drawers.

The identification and positioning system includes tool profiles, or visual tool identification structures, such as cross-sectional views of the tools contained within each drawer and each drawer compartment within the cabinet.

In operation, press brake tools are stored in the cabinets as a convenience to protect the tools and provide a clean environment for them. When the press brake tools were previously stored in the cabinets, it was noted that it was difficult to remember where a particular press brake tool was located. Opening all of the drawers to look for the specific tool took too much time. The use of a pictorial representation attached to the cabinet is an instant solution to the problem. The placement of the sheet mounted on or to the side of the cabinet where each drawer is represented by an outline with its compartments containing the press brake tooling allows the press brake machine operator to locate the required tools quickly with minimal loss of machine time.

The sheet and profiles can be provided as the visual representation of the contents of the cabinet. The sheet is mounted to the side of the press brake tool cabinet. Profiles of the tools in each cabinet drawer are attached to the surface of the sheet. The sheet is mounted on or to the side of the cabinet and with the attached profiles represent the contents of each drawer contained within the cabinet. The sheet with the attached tool profiles provides a cross sectional view of the press brake tools within each cabinet drawer. If a tool location is changed in the cabinet, the corresponding tool profile may be changed to a corresponding new location on the sheet.

What is claimed is:

1. A tool storage cabinet and attached visual tool identification and location system comprising:

a tool storage cabinet having a sidewall with an outer surface and a plurality of drawers, each drawer being constructed with tool supporting structures forming a plurality of tool receiving compartments;

a sheet mounted to the outer surface of the side wall of the tool storage cabinet, the sheet having a front surface with a visual depiction of each tool receiving compartment of each drawer in the form of a diagrammatic cross section view of the tool receiving compartments in the drawer, the visual depiction of each tool receiving compartment of each drawer being horizontally aligned with a corresponding one of the drawers of the tool storage cabinet; and a plurality of tool profiles, each tool profile being a pictorial representation of a tool in one of the compartments of one of the drawers in the cabinet, the tool profiles being removably mounted to the sheet such that each tool profile is located on the visual depiction of the tool receiving compartment corresponding to the compartment and the drawer location of the tool represented by the tool profile, wherein the sheet and the tool profiles replicate visually the entire tool content of the cabinet and whereby the system conveys to a user of the exact location of the tool without the user having to open the drawers of the cabinet.

2. The tool storage cabinet and attached visual tool identification and location system of claim 1, wherein:

each of the plurality of the tool profiles and the visual depictions of the tool receiving compartments are scaled to the size of the sidewall of the tool storage cabinet.

3. The tool storage cabinet and attached visual tool identification and location system of claim 1, wherein:

each tool profile is a scaled cross section of the tool represented by the tool profile.

4. The tool storage cabinet and attached visual tool identification and location system of claim 1, including:

an adhesive between the sheet and the outer surface of the side wall of the tool storage cabinet; and wherein the sheet is formed of plastic material;

each of the plurality of the tool profiles and the visual depictions of the tool receiving compartments are scaled to the size of the side wall of the tool storage cabinet; and each tool profile is a scaled cross section of the tool represented by the tool profile.

5. The tool storage cabinet and attached visual tool identification and location system of claim 1, wherein:

each of the tool profiles is connected to the sheet by a hook and loop fastener.

6. The tool storage cabinet and attached visual tool identification and location system of claim 5, wherein:

the sheet is formed of plastic material; and including an adhesive between the sheet and the outer surface of the sidewall of the tool storage cabinet.

7. The tool storage cabinet and attached visual tool identification and location system of claim 6, wherein:

each of the plurality of the tool profiles and the visual depictions of the tool receiving compartments are scaled to the size of the side wall of the tool storage cabinet; and each tool profile is a scaled cross section of the tool represented by the tool profile.

8. The visual tool identification and location system of claim 1, wherein:

each outline of the tool receiving compartments in the drawer formed on the sheet is horizontally aligned with a corresponding one of the drawers in the tool storage cabinet.

9. The visual tool identification and location system of claim 8, wherein:

each of the tool receiving compartments is structured to extend parallel to every other tool receiving compartment.

10. The tool storage cabinet and attached visual tool identification and location system of claim 9, including:

a magnet attached to each of the tool profiles.

11. The tool storage cabinet and attached visual tool identification and location system of claim 10, including:

an adhesive between the sheet and the outer surface of the side wall of the tool storage cabinet; and wherein the sheet is formed of plastic material.

12. The tool storage cabinet and attached visual tool identification and location system of claim 9, wherein:

the visual depiction of each compartment is a diagrammatic outline formed on the sheet.

13. The tool storage cabinet and attached visual tool identification and location system of claim 12, including:

a magnet attached to each of the tool profiles.

14. The tool storage cabinet and attached visual tool identification and location system of claim 13, wherein:

each of the plurality of the tool profiles and the visual depictions of the tool receiving compartments are scaled to the size of the sidewall of the tool storage cabinet.

15. The tool storage cabinet and attached visual tool identification and location system of claim 14, wherein:

each tool profile is a scaled cross section of the tool represented by the tool profile.

16. The tool storage cabinet and attached visual tool identification and location system of claim 15, wherein:

the sheet is formed of plastic material; and including an adhesive between the sheet and the outer surface of the sidewall of the tool storage cabinet.

17. A visual tool identification and location system adapted to be attached to a tool storage cabinet having a sidewall outer surface, a plurality of tool containing drawers and a plurality of tool receiving compartments in each drawer, the tool identification and location system comprising:

a sheet adapted to be mounted to the outer surface of the side wall of the tool storage cabinet, the sheet having a front surface with an outline of each tool receiving compartment of each drawer, the outline of each tool receiving compartment on the sheet being arranged to be aligned with a corresponding one of the drawers of the tool storage cabinet; and wherein each of the plurality of tool receiving compartments is aligned parallel to one another; and the front surface of the sheet is adapted to removably receive a plurality of tool profiles, each tool profile being a pictorial representation of a tool in the cabinet, and each tool profile being locatable on the sheet on one of the outlines of one of the drawers and one of the tool receiving compartments corresponding to the drawer and the compartment location in the tool cabinet of the tool represented by the tool profile, the sheet and the tool profiles replicating visually the entire contents of the cabinet and whereby the system conveys to a user of the exact location of the tool without the user having to open the drawers of the cabinet.

18. The visual tool identification and location system of claim 17, including:

an adhesive between the sheet and the outer surface of the side wall of the tool storage cabinet; and wherein the sheet is formed of plastic material.

* * * * *